United States Patent [19]

Nankou et al.

[11] Patent Number: 5,040,027

[45] Date of Patent: Aug. 13, 1991

[54] PRINTING APPARATUS

[75] Inventors: Takahiko Nankou; Yuji Takashima; Soichiro Mima, all of Nishinomiya; Hiroshi Onishi, Hirakata, all of Japan

[73] Assignee: Matsushita Electric Industrial Company, Ltd., Osaka, Japan

[21] Appl. No.: 448,837

[22] Filed: Dec. 12, 1989

[30] Foreign Application Priority Data

Dec. 16, 1988 [JP] Japan ..... 63-319096

[51] Int. Cl.[5] ..... G03G 15/14

[52] U.S. Cl. ..... 355/273; 355/271

[58] Field of Search ..... 355/271, 273, 277, 278, 355/279, 280, 281; 430/97, 126; 346/159

[56] References Cited

U.S. PATENT DOCUMENTS

| | | | |
|---|---|---|---|
| 2,995,085 | 8/1961 | Walkup . | |
| 3,083,684 | 4/1963 | Carlson . | |
| 3,506,347 | 4/1970 | Carlson . | |
| 3,639,245 | 2/1972 | Nelson | 430/109 |
| 4,155,093 | 5/1979 | Fotland et al. | 346/159 |
| 4,465,754 | 8/1984 | Kuin et al. | 430/97 X |
| 4,876,561 | 10/1989 | Schmidlin | 346/159 |

FOREIGN PATENT DOCUMENTS

| | | |
|---|---|---|
| 0040128 | 11/1981 | European Pat. Off. . |
| 37-67576 | 3/1962 | Japan . |

OTHER PUBLICATIONS

EPO Search Report; EP 89313176; 8/11/90.

Patent Abstracts of Japan, vol. 6, No. 30 (P-103)[908], 23rd Feb. 1982; & JP-A-56 150 778 (Fuji Xerox K.K.) 2-11-1981.

*Primary Examiner*—A. T. Grimley

*Assistant Examiner*—Sandra L. Hoffman

*Attorney, Agent, or Firm*—Stevens, Davis, Miller & Mosher

[57] ABSTRACT

A printing apparatus is disclosed. A toner image is formed on an image carrier. A solvent supply device supplies a solvent to the toner image in a direction toward such a side that the toner image makes contact with an image bearing medium, the solvent lowering the viscosity of the powder image. A transfer device presses the image bearing medium against the toner image of which viscosity is lowered by the solvent, thereby transferring the toner image to the image bearing medium.

12 Claims, 3 Drawing Sheets

PRINTING APPARATUS

BACKGROUND OF THE INVENTION

This invention relates to a printing apparatus, such as a copying machine, a printer and a facsimile, in which the viscosity of a toner image is reduced to a low valve by use of a solvent of said toner before transfer of the toner image for obtaining a hard copy.

Typical examples of conventional recording systems utilizing toners include electrophotography and electrostatic recording. In such systems, an electrostatic latent image is formed on a charge carrier such as an photoconductive medium and an electrostatic recording medium, and this latent image is developed by charged toner having a polarity opposite to that of the latent image, so as to obtain a toner image. Then, the toner image thus obtained is fixed into a final recorded form.

In the electrostatic recording, the electrostatic latent image is formed on electrostatic recording paper by a recording electrode or the like, and this latent image is developed by the toner. This electrostatic recording paper serves as the charge carrier and an image bearing medium. Therefore, the electrostatic recording system obviates a step of transferring the toner image from the charge carrier to the image bearing medium. On the contrary, the electrophotography inevitably requires the step of transferring the toner image from the photosensitive medium (charge carrier) to the image bearing medium, and the step of fixing the thus transferred image.

The present invention is devised so as to improve the step of transferring a toner image, for example, in the electrophotography, or the step of fixing a transferred image.

Examples of known transfer systems of transferring a toner image from a charge carrier to an image bearing medium include an electrostatic transfer method, an adhesion transfer method and a pressure transfer method.

First, the electrostatic transfer method will now be described. Examples of such electrostatic transfer methods include a corona transfer method and a bias transfer method. In the corona transfer method, an image bearing paper sheet is set on the charge carrier, and a charge of a polarity opposite to that of the toner charge is applied by a corona charger to the paper of the reverse side of the charge carrier, thereby transferring the toner image to the paper sheet under Coulomb force. On the contrary in the bias transfer method, an image bearing paper sheet is set on a toner image on a photoconductive drum, and a conductive electrode drum to which direct current is applied is pressed against the reverse side of the paper sheet so that the toner image is transferred onto the paper sheet by Coulomb force.

However, when using the corona transfer method so as to transfer the toner image, there has been encountered a problem such that the toner transfer efficiency greatly depends on the electric resistance of the image bearing sheet. Particularly in a high humidity condition, the image bearing sheet absorbs the moisture so that its electric resistance decreases, and as a result, the toner image could not be transferred to the image bearing sheet at all. This offers a serious problem. Furthermore, during the corona transfer, the toner image is susceptible to scattering, resulting in a problem that the printed image is dim.

Further, in an electrophotographic apparatus employing the corona transfer, high resistance toner is used. It is said that the critical resolution, when using the high resistance toner, is equal to four to five times as large as than the particle size of the toner particles. Therefore, a printed image of high resolution could not be expected.

In an ordinary two-component development using high resistance toner, there has been encountered a problem of a so-called edge effect.

In order to overcome the degrading of the image quality caused by the use of the high resistance toner, it has been proposed to use electrically-conductive toner. Such a method is disclosed, for example, in U.S. Pat. No. 3,639,245.

However, when the conductive toner is used, the transfer can not be carried out by the corona transfer method. Therefore, when the conductive toner is used, adhesion transfer method using an intermediate medium, the above-mentioned pressure transfer method, or other methods should be employed.

Next, the adhesion transfer method will now be described. In the adhesion transfer method, the toner is transferred utilizing the adherent or sticky force of a image bearing sheet. Althernatively, when transferring the toner to ordinary paper, the toner image is once transferred to an intermediate transfer medium, and then is again transferred therefrom to the ordinary paper.

Such an adhesion transfer method is described, for example, in Japanese Patent Eexamined Publication No. 46-41679. However, at the steps of retransferring the toner image from the intermediate transfer medium to the image bearing sheet and fixing the thus transferred image, the toner on the intermediate transfer medium is heated by a heating roller so as to be rendered viscous. Therefore, the intermediate transfer member is heated by the heating roller, and the photoconductive member in contact with the intermediate transfer medium must be also heated. As a result, the photoconductive medium undergoes thermal effects, which causes adverse effects such as a variation in the charge characteristics of the photoconductive medium and a shortened service life of the photoconductive medium.

Next the pressure transfer method will now be described. In the pressure transfer method, pressure-fixing toner is used, and an image bearing paper sheet is held between a photoconductive drum and a press roller. The toner is transferred and fixed to the image bearing sheet by a pressure, thus simultaneously effecting the transfer and the fixing.

In this method, since a high pressure is applied to the appartus, the apparatus is required to have an increased mechanical strength, and the drive torque is also increased. Therefore, there has been encountered a problem that only the type of photosensitive members having a high pressure resistance can be used. Furthermore, the image bearing paper sheet is subjected to calendering because a high pressure is applied to the image bearing sheet. For this reason, a gloss develops on the surface of the image bearing sheet, and the fixing ability is inferior to that of the other fixing methods.

(b) Examples of conventional fixing methods include a thermal fixing method, a pressure fixing method and a solvent vapor fixing method.

First, the thermal fixing method will now be described. In the thermal fixing method, the fixing is carried out by melting toner by means of a heating roller. This method is widely used at present. In this method, when electric power is supplied to the apparatus to initiate its operation, there is required a certain period of time for warming up the apparatus. Also, a large amount of thermal energy is required for effecting the fixing. For these reasons, a power source of a large capacity is needed for the heating roller, which results in a problem that the electric power consumption of the apparatus is large. Furthermore, the fixing is carried out by heat, and therefore even if it is desired to increase the fixing rate, this can not be achieved because the temperature of the heating roller can not be increased from the viewpoint of safety. Thus, this method suffers from such a drawback that the recording can not be carried out at a high speed.

Next, the pressure fixing method will now be described. Toner used in this pressure fixing method is made of a pressure sensitive material, the viscosity of which is lowered when pressure is applied to the toner. Examples of such toner materials include paraffin, wax and rubber-like soft polymer. In this method, a high pressure is applied to the toner to lower its viscosity, so that the toner can penetrate into the fibers of the image bearing paper sheet, thereby carrying out the transfer and fixing. This method has offered problems such that the calendering of the image bearing sheet produces a gloss on the printed image and lowers the fixing ability as described above, that the weight balance of the copying machine is not good due to a heavy weight, resulting in less portability, and that impact noise is produced when the paper sheet is discharged from the copying machine.

Next, the solvent vapor fixing method will now be described. In this solvent vapor fixing method, solvent vapor dissolves a toner image on an image bearing paper sheet, thereby fixing the toner image to the image bearing sheet. When it is considered that this method is used in various environments, several problems are encountered. Namely, it is difficult to control the pressure of the solvent vapor to a constant level. It is necesasry to provide means for preventing the leakage of the solvent vapor. It is difficult to use cut paper sheets.

The conventional printing apparatuses which have been widely available employ a combination of the aforesaid electrostatic transfer (the corona transfer method in particular) and the thermal fixing.

(c) Japanese Patent Unexamined Publication No. 62-67576 discloses a prior art method in which a toner image formed on an image carrier is dissolved by a solvent so as to make the toner image viscous, and the viscous toner image is transferred to an image bearing medium through adhesion. This method will now be described.

First, a toner image is formed on a photoconductive drum by an ordinary electrophotographic process. Then, a toner powder-dissolving drum (hereinafter referred to as "dissolving drum") coated with a solvent capable of dissolving the toner is in opposite to the photoconductive drum with a space there between. Then, the toner image on the photoconductive drum is electrostatically transferred to the dissolving drum by a transfer charging device mounted within the dissolving drum. The toner thus transferred to the dissolving drum is dissolved by the solvent and is made to be viscous. In this condition, when a paper sheet is brought into intimate contact with the toner image, the toner image is adhesion-transferred to the paper sheet by the adherent or sticky force of the viscous toner.

However, the printing apparatus of this type has the following problems:

(1) A sharp printed image can not be obtained.

The reason for this will be described. If there is a gap between the photoconductive drum and the dissolving drum when the toner image on the photosensitive drum is to be electrostatically transferred to the dissolving drum, the toner image is scattered because of a scattering phenomenon as is well known in the art. As a result, the transferred toner image on the dissolving drum is dim. Thus, the above-mentioned problems of the conventional electrostatic transfer method have not been solved.

(2) To deal with the above scattering problem, it is considered to effect the electrostatic transfer by making the photoconductive drum into intimate contact with the dissolving drum. However, with the conventional method, a new problem arises such that the resultant printed image has increased void portions and therefore is unclear.

The reason for this is that even if a sharp toner image is transferred to the dissolving drum, the toner image made to be viscous by the solvent is adhesion-transferred while being distributed possively to both photoconductive drum and dissolving drum.

(3) The solvent begins the dissolve of the toner transferred to the dissolving drum from that surface of the toner making contact with the dissolving drum toward the paper sheet to which the toner is to be transferred. In other words, when viewed from the side of the paper sheet, the toner is dissolved from its inner surface toward its outer surface.

Accordingly the toner is made to be viscous earlier at its inner side adjacent to the dissolving drum than at its outer side adjacent to the paper sheet. For this reason, if the solvent supplied to the dissolving drum is in a small amount, the adherent force acts only on the dissolving drum side and does not act on the paper sheet side, and as a result the toner is not transferred to the paper sheet at all, thus failing to obtain a printed image. On the other hand, if the solvent is suppted in an increased amount, the dissolved toner is difused, and therefore the lines of the printed image become thick, thus affecting the reproduction of thin lines.

Anyway, in such a method in which the solvent is applied to the toner from the inner surface of the toner, it is extremely difficult to control the amount of the solvent, and therefore it is difficult to stably obtain a clear printed image.

SUMMARY OF THE INVENTION

In view of the above deficiencies of the prior art, an object of this invention is to provide a printing apparatus which is simple in construction, and enables the transfer and fixing of a toner image with low energy, and can produce a printed image of a high resolution free from scattering of toner.

According to the present invention, there is provided a printing apparatus comprising:

(a) image forming means for forming an image of toner on an image carrier;

(b) solvent supply means for supplying a solvent to the toner image on the image carrier in a direction toward such a side that the toner image as to make contact with an image bearing medium, the solvent lowering the viscosity of the powder image; and (c) transfer means for pressing the image bearing medium against the powder image of which viscosity is lowered by the solvent, thereby transferring the powder image to the image bearing medium.

The viscosity of the toner image on the image carrier of colored toner is lowered by the solvent, so that the transfer and the fixing can be carried out simultaneously. Therefore, the printing apparatus can perform the printing at high speed with a lower electric power consumption.

Further, in the present invention, irrespective of the conductivity of the toner and the electrical resistance of the image bearing sheet, the toner image is not subjected to toner scattering when effecting the transfer, and the printing apparatus can produce a clear printed image of a high resolution.

DESCRIPTION OF THE PREFERRED EMBODIMENTS OF THE INVENTION

The invention will now be described in detail with reference to the drawings.

Figure 1:
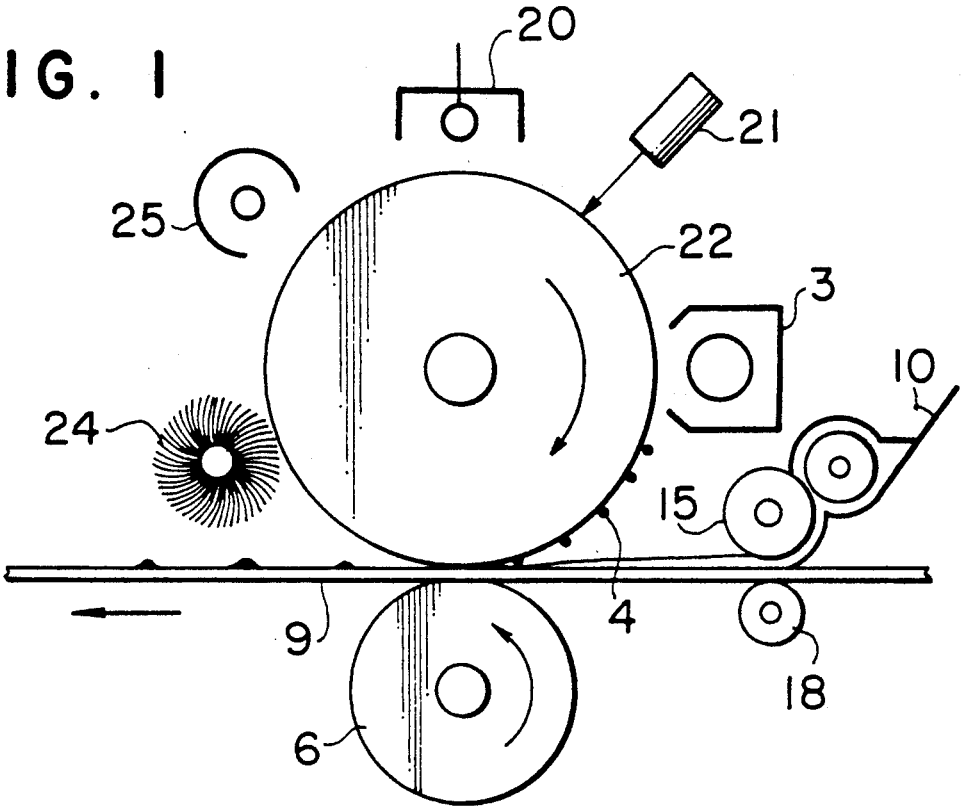
FIG. 1 is a schematic view showing a basic concept of the present invention in which a solvent is supplied to a toner image on an image carrier (In FIG. 1, the toner image is formed by an electrophotographic process, and the toner image is pressed against an image bearing paper sheet coated with the solvent, thereby effecting the transfer and the fixing. Specific examples of this general concept are shown in FIGS. 2 and 3)

FIG. 1 shows the basic concept in which a solvent is supplied to a toner image on an image carrier. With this arrangement, since the solvent is supplied to the toner image on the image carrier, the apparatus can be simple in construction.

Specific examples employing this construction will be described later with reference to FIGS. 2 and 3.

Figure 2:
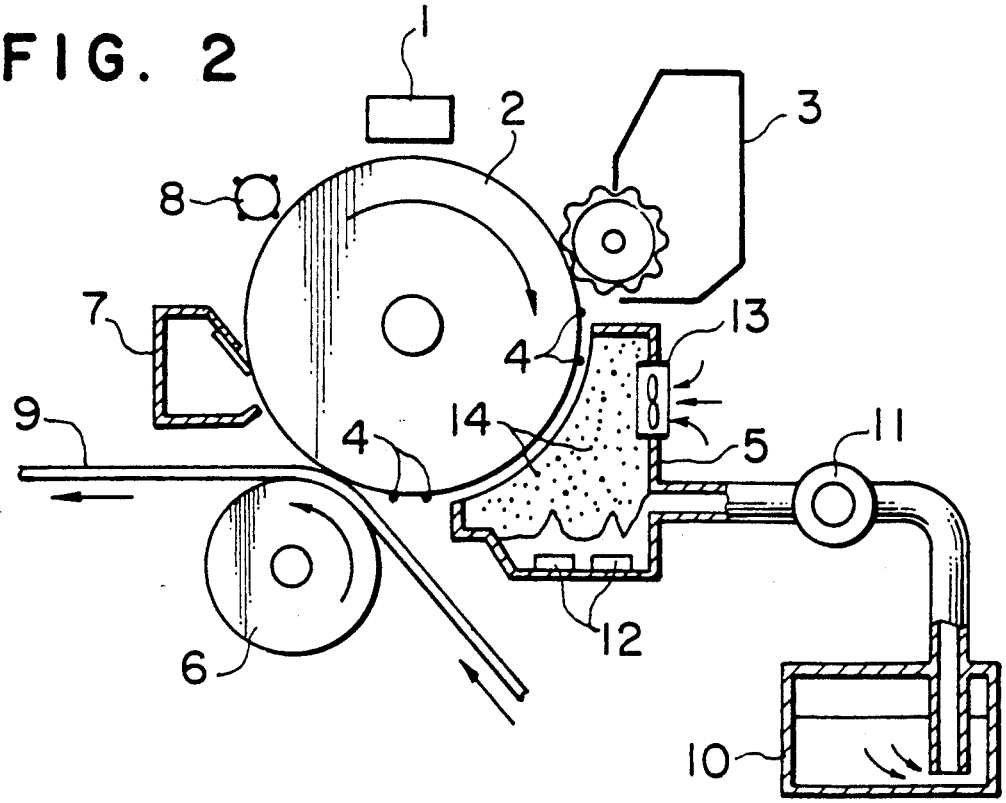
FIG. 2 is a schematic view of a printing apparatus in a specifiec form of the present invention employing a so-called ion projection electrographic printing process as an image forming measure for forming a toner image (In this embodiment, the solvent is supplied to the toner image on an image carrier before effecting the transfer)

FIG. 2 shows the structure in which a solvent is supplied to a toner image before the toner image is brought into contact with an image bearing medium. With this construction, the supply amount of the solvent does not vary depending on the solvent retention properties of the image bearing medium, and therefore there can be given a printing apparatus which can use various kinds of image bearing mediums.

Figure 3:
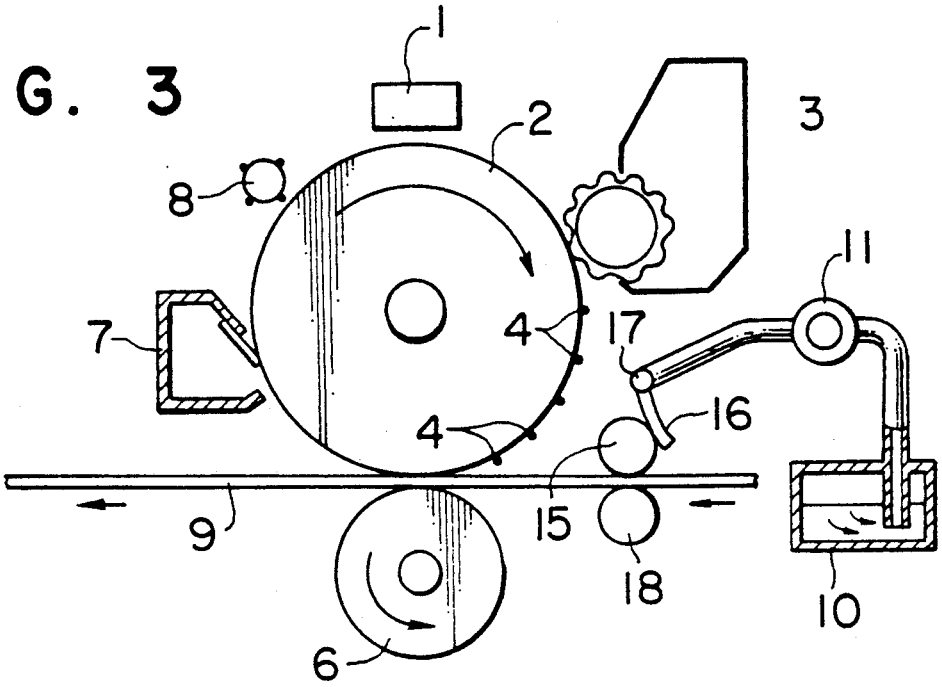
FIG. 3 is a schematic view of a specific form of printing apparatus employing an ion projection electrographic printing process as in FIG. 2 (In this embodiment, a solvent is supplied to a toner image on an image carrier simultaneously with the transfer by making an image bearing sheet holding the solvent into press-contact with the image carrier)

If it is possible to limit the use of image bearing mediums to certain kinds, the method shown in FIG. 3 is advantageous in which the solvent is supplied to the toner image by pressing the powder image against the image bearing medium retaining the solvent. With this arrangement, the solvent supply means can be constituted by a simpler device, and besides a high-speed recording can be achieved relatively easily.

Figure 4:
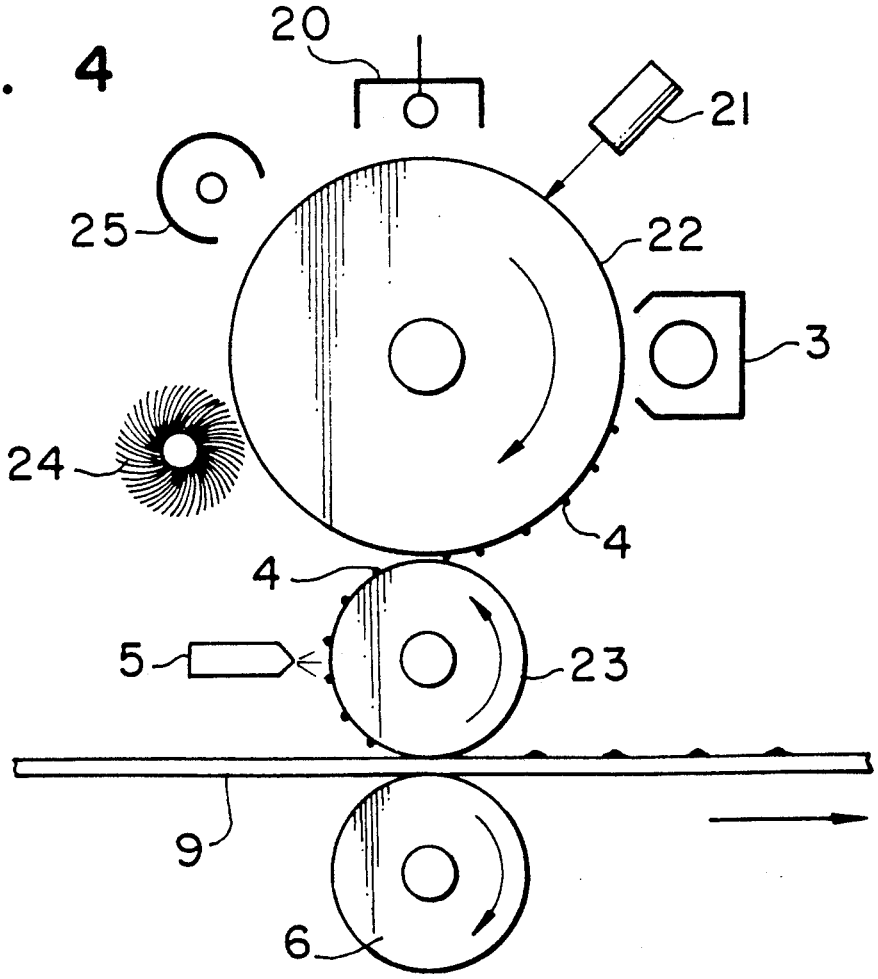
FIG. 4 is a schematic view showing a basic concept in which a toner image on an image carrier is once transferred to an intermediate transfer medium, and then the solvent is supplied in a non-contact manner to the toner image on the intermediate transfer medium (In FIG. 4, the toner image is formed by an electrophotographic process, and a sprayer or atomizer sprays the solvent to the toner image, and a specific example of this basic concept is shown in FIG. 5)
Figure 5:
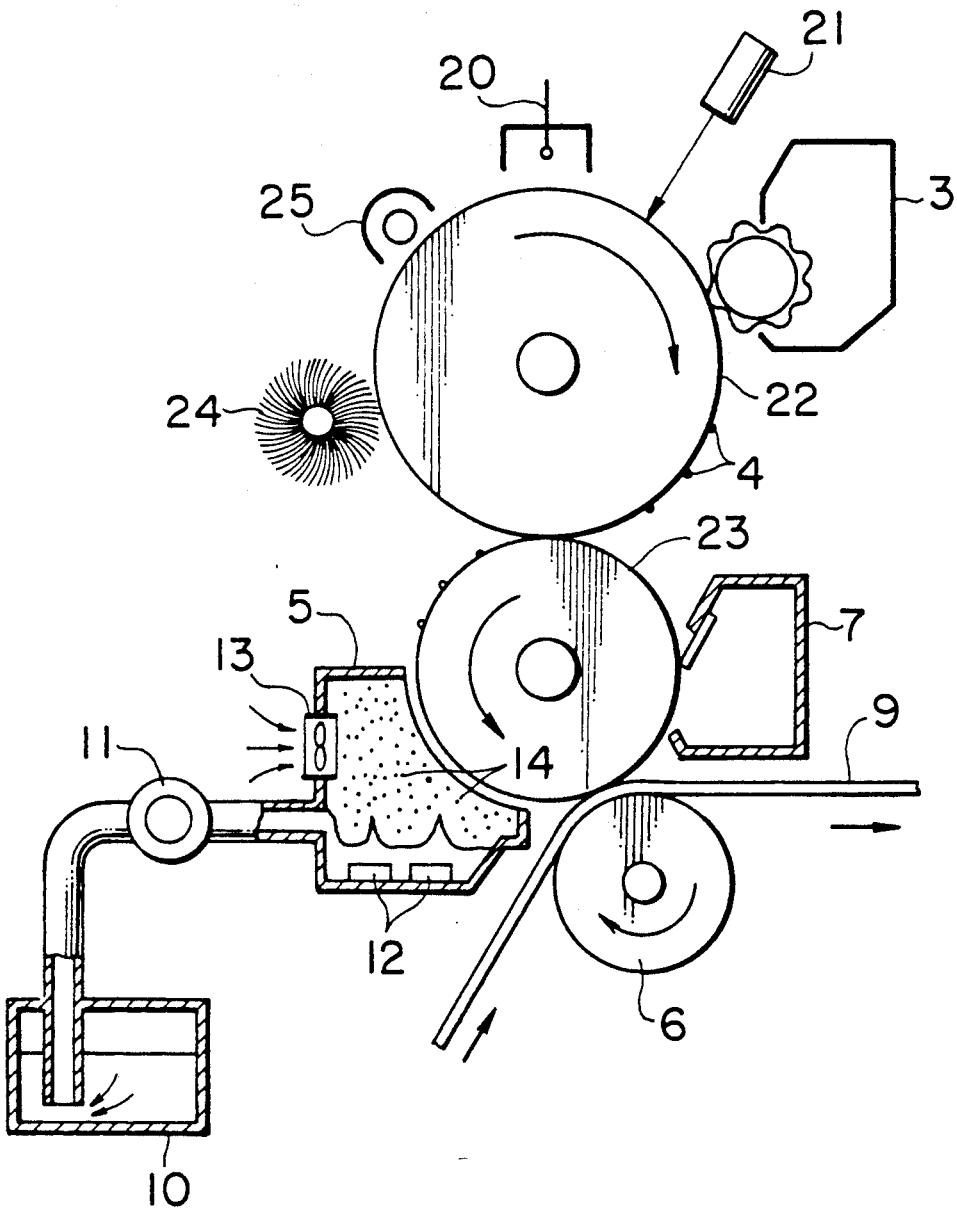
FIG. 5 is a schematic view of another printing apparatus in a specific fom of the present invention employing an electrophotographic process as an image forming measure for forming the toner image (In this embodiment, the toner image on an image carrier is once transferred to an intermediate transfer medium, and then the solvent is supplied in a non-contact manner to the toner image on the intermediate transfer medium before the toner image is transferred to an image bearing paper sheet).

In the case where the image carrier does not have a solvent resistance, it is effective that the toner image is once transferred to an intermediate transfer medium, and then the solvent is supplied in a non-contact manner to the toner image on the intermediate transfer medium, as shown in FIGS. 4 and 5.

FIG. 4 shows the basic concept of the printing apparatus incorporating such an intermediate transfer medium, and a specific example of such a structure will be described later with reference to FIG. 5.

FIG. 2

Reference is first made to a specific form of the invention in which a solvent is supplied to a toner image on an image carrier before the transfer is effected. FIG. 2 schematically shows a first embodiment of a printing apparatus of the present invention:

In this embodiment, an image forming means for forming a toner image comprises an ion projection electrographic printing process by way of example. Such an ion projection electrographic printing process is disclosed in U.S. Pat. No. 4,155,093.

In FIG. 2, reference numeral 1 denotes an ion projection print head which applies ions in accordance with an image signal. Reference numeral 2 denotes a dielectric drum serving as an image carrier, the dielectric drum 2 comprising a drum body of an electrically conductive material (e.g., aluminum) and a dielectric layer coated on the outer peripheral surface of the drum body. Preferably, the surface of the dielectric drum 2 should be excellent in solvent resistance and have a smooth surface and low free-surface energy. It is desirable that the surface of the dielectric drum 2 be coated with fluoroplastics, polyolefin or other suitable materials. Reference numeral 3 denotes a developing unit, and reference numeral 4 denotes a toner image formed on the dielectric drum 2.

The toner used in this embodiment is a one-component magnetic conductive toner.

The ion projection print head 1 and the developing machine 3 constitute in combination an image forming means for forming the toner image 4 on the dielectric drum 2.

A solvent mist-generating device (solvent supply means) 5 supplies to the dielectric drum 2 a solvent in the state of a mist, the solvent serving to lower the viscosity of the toner.

A press roller (transfer means) 6 is pressed against the dielectric drum 2. Reference numeral 9 denotes an image bearing paper sheet (image bearing medium).

The image bearing sheet 9 is, for example, PPC paper of 64 g/m$^2$.

The press roll 6 cooperates with the dielectric drum 2 to press the toner image (which has been formed on the dielectric drum 2 and has been lowered in viscosity) against the image bearing sheet 9.

A cleaning unit 7 removes the residual or untransferred toner, remaining on the dielectric drum 2, from the dielectric drum 2, the cleaning unit 7 comprising a metal blade.

Reference numeral 8 denotes a static eliminator for eliminating an electrostatic latent image on the dielectric drum 2.

Reference numeral 10 denotes a solvent tank, 11 a solvent supply pump, 12 an ultrasonic vibrator, 13 an air blower fan, and 14 the solvent mist.

In this embodiment, that constituent or ingredient of the toner whose viscosity is lowered by the solvent is binder resin. A suitable solvent capable of lowering the viscosity of the binder resin is selected.

Examples of the combination of the binder resin and the solvent include styrene resin and toluene, acrylic resin and acetone, epoxy resin and dimethyl ethane, and water solbule resin (e.g., PVA (Polyvinyl-Alcohol), CMC (Sodium Carboxymethyul Cellulose) and water. In view of safety and the cost, it is preferred to use water as the solvent.

In this embodiment, PVA is used as the binder resin, and carbon black and a magnetic material are dispersed in the PVA, and this dispersion is pulverized to produce one-component magnetic conductive toner. The resistivity of the toner used in this embodiment was about $10^6\Omega\cdot$cm, and water was used as the solvent.

The operation of the printing apparatus of the first embodiment will now be described.

First, in accordance with image signals, the electrostatic latent image is formed on the dielectric drum 2 by the ion projection print head 1. This electrostatic latent image is developed by the developing unit 3, so that the toner image 4 is formed on the dielectric drum 2.

The solvent mist-generating device 5 is connected to the solvent tank 10, and the solvent is supplied to the solvent mist-generating device 5 by the solvent supply pump 11. The solvent supplied to the solvent mist-generating device 5 is formed into the solvent mist 14 by the ultrasonic vibrators 12 (which are provided by at least are in number) mounted within the solvent mist-generating device 5. The solvent mist 14 is directed toward and supplied to the peripheral surface of the dielectric drum 2 by air stream from the air blower fan 13 mounted on a casing of the solvent mist-generating device 5, thereby lowering the viscosity of the toner image 4 on the dielectric drum 2.

Thus, the solvent mist 14 is supplied by the solvent mist-generating device 5 to the toner image 4 on the dielectric drum 2.

At this time, the solvent mist 14 is supplied to the toner image 4 in a direction toward the surface of the toner image 4 on such a side as to make contact with the image bearing sheet 9. Therefore, the lowering of the viscosity of the toner image 4 proceeds from the side on which the toner image is to be brought into contact with the image bearing sheet 9.

It is preferred that the amount of supply of the solvent mist 14 at this time be about several grams/m$^2$, but this amount varies depending on the kind of the binder of the toner.

The viscosity of the toner image 4 is thus sufficiently lowered by the solvent mist 14, and in this condition the image bearing sheet 9 is pressed against the dielectric drum 2 by the press roller 6.

At this time, since the viscosity of the toner image 4 has been lowered by the solvent, it will be readily appreciated that the pressure applied to the press roller 6 can be much lower than that required in an apparatus utilizing the conventional pressure fixing method. Although the pressure applied to the press roller 6 varies depending on the degree of lowering of the viscosity of the toner image 4, this pressure can be reduced to one-several to one-several hundredths of the pressure required for the conventional pressure fixing method.

Simultaneously when the toner image 4 is transferred to the image bearing sheet 9 by the pressure, the toner penetrates into the fibers of the image bearing sheet 9 and is therefore fixed thereto. In this condition, the solvent contained in the thus transferred toner evaporates or is dried through the penetration, thereby obtaining the paper in a final recorded form.

At this time, the toner image 4 has begun to become viscous on such a side that the toner image 4 makes contact with the image bearing sheet 9, and therefore the amount of the residual (untransferred) toner remaining on the dielectric drum 2 is small. As a result, there can be obtained a printed image with a higher transfer efficiency than that achieved by conventional transfer methodes.

The residual toner remaining on the dielectric drum 2 is removed by the cleaning unit 7, and the static electricity is eliminated from the dielectric drum 2 by the static eliminator 8.

If the condensation of water is present on the dielectric drum 2 when the above cleaning is to be carried out by the cleaning unit 7, this condensate is also removed from the dielectric drum 2 together with the residual toner.

If the cleaning unit 7 is not sufficiently effective in removing the residual solvent from the dielectric drum 2, then it may be effective to provide a heater or the like in the vicinity of the dielectric drum 2 so as to dry by force the residual solvent on the dielectric drum 2.

As described above, in this first embodiment, the solvent is supplied to the toner image on the image bearing sheet before the transfer is carried out, and the solvent mist-generating device 5 supplies the solvent in the state of a mist to the toner image 4 on the dielectric drum 2, and the press roller 6 presses the image bearing sheet 9 against the toner image 4 whose viscosity is lowered by the solvent. In this first embodiment, by virtue of the provision of the solvent mist-generating device 5 and the press roller 6, there can be offered a printing apparatus which can carry out the transfer and the fixing simultaneously, and can attain a high-speed printing, and consumes less electric power, and is simple in construction.

Further, the electrically-conductive toner which heretofore could not be easily transferred and fixed can be easily transferred without scattering, and the good and high-efficiency transfer can be achieved regardless of the resistivity of the toner.

Further, since the solvent is supplied to the toner image before the toner image is brought into contact with the image bearing medium, there can be offered a printing apparatus which can use various kinds of image bearing mediums.

FIG. 3

Next, reference is now made to a specific example of the invention in which a solvent is supplied to a toner image on an image carrier simultaneously, when effecting the transfer of the toner image. FIG. 3 schematically shows a second preferred embodiment of a the solvent coating roller 15. By virtue of the provision of the solvent supply felt 16, the amount of supply of the solvent to the solvent coating roller 15 is made constant.

At a final stage, the solvent coating roller 15 is pressed against the image bearing sheet 9, thereby coating the solvent onto the surface of the image bearing sheet 9.

The operation of the printing appartus of this embodiment will now be described.

According to the same procedure as described above in the first embodiment, a toner image 4 is formed on a dielectric drum 2. Concurrently with this, the solvent is supplied from the solvent coating roller 15 to the image bearing sheet 9, and is coated on the surface of the image bearing sheet 9. In this condition, the image bearing sheet 9 is pressed against the dielectric drum 2 by the press roller 6.

At this time, the toner image 4 on the dielectric drum 2 is brought into contact with the solvent on the image bearing sheet 9 so that the lowering of the viscosity of the toner image 4 proceeds on such a side that the toner image 4 makes contact with the image bearing sheet 9. Simultaneously, since the pressure is applied by the press roller 6 to the toner image 4 and the image bearing sheet 9, that portion of the toner image 4 which is lowered in viscosity is deformed, and penetrates into the fibers of the image printing appartus of the present invention. This embodiment is advantageous where paper to be used is limited to have a uniform solvent retention.

Since the printing apparatus of FIG. 3 is basically of the same construction as that of the printing appartus of FIG. 2, like reference numerals are used to designate like parts in this figure, and detailed explanations of such parts will be omitted.

In FIG. 3, reference numeral 15 denotes a solvent coating roller for supplying or coating a solvent onto an image bearing paper sheet 9, reference numeral 16 a solvent supply felt for supplying the solvent to the solvent coating roller 15, and reference numeral 17 a solvent supply pipe for impregnating the solvent supply felt 16 with the solvent.

The solvent supply pipe 17 is connected to a solvent tank 10 via a solvent supply pump 11, and is held in intimate contact with the upper end of the solvent supply felt 16, as shown in FIG. 3.

A plurality of apertures are formed in that portion of the solvent supply pipe 17 which makes contact with the solvent supply felt 16, and the solvent fed from the solvent supply pump 11 flows through these apertures, thereby impregnating the solvent supply felt 16 with the solvent.

The solvent supply felt 16 is held in contact with the solvent coating roller 15 so as to form a liquid film of the solvent on the peripheral surface of bearing sheet 9. After that, the portion of the transferred toner image 4 which is not lowered in viscosity is to be lowered by the solvent contained on the paper 9, and finally the toner image 4 is fixed. In this condicion, the solvent contained in the thus transferred toner evaporates or is dried through the penetration, thereby obtaining the paper in a final recorded form.

As described above, in this embodiment, the solvent is supplied to the toner image on the image carrier simultaneously with the transfer of the toner image. In this second embodiment, there is provided the solvent coating roller 15 for coating the solvent onto the image bearing sheet 9, and the solvent is supplied to the toner image 4 through the image bearing sheet 9 coated with the solvent. With this arrangement, in addition to the above-mentioned advantages of the first embodiment, this second embodiment has a further advantage that the supply of the solvent can be carried out by a simple construction. Furthermore, since the solvent is supplied by the coating roller, the high-speed printing can be achieved relatively easily. This will be appreciated, for example, from the case with a printing machine.

FIG. 5

Next, reference is now made to a specific form of the invention in which a toner image on an image carrier is once transferred to an intermediate transfer medium, and then a solvent is supplied in a non-contact manner to the toner image on the intermediate transfer medium before this toner image is transferred to an image bearing sheet. FIG. 5 schematically shows a third preferred embodiment of a printing apparatus of the present invention.

In this embodiment, an image forming means for forming a toner image comprises an electrophotographic process by way of example.

Since the apparatus of this embodiment shown in FIG. 5 is basically of the same construction as those of the apparatuses of FIGS. 2 and 3, like reference numerals are used to designate like parts in the figure, and detailed explanations of such parts will be omitted.

In FIG. 5, reference numeral 23 denotes a adhesive rubber roller (intermediate transfer medium) disposed in intimate contact with a photoconductive drum 22. The adhesive rubber roller 23 comprises a roller body and a adhesive rubber coated on the peripheral surface of the roller body. The adhesive rubber roller 23 is brought into contact with that portion of the photosenstivie drum 22 on which the toner image 4 is already formed, so that the toner image 4 on the photoconductive drum 22 is once transferred to the adhesive rubber roller 23 because of the sticky or adherent properties of the roller surface.

Reference numeral 5 denotes a solvent mist-generating device, and in this embodiment this device 5 is so positioned as to supply a solvent mist to the peripheral surface of the adhesive rubber roller 23. A press roller 6 is so positioned that it can press an image bearing paper sheet 9 against the adhesive rubber roller 23 after the solvent mist 14 is supplied to the toner image 4 on the adhesive rubber roller 23 to lower the viscosity of the toner image 4.

The operation of the printing apparatus of the above-mentioned third embodiment will now be described.

First, according to the same procedure as in a conventional apparatus, the toner image 4 is formed on the photoconductive drum 22.

Then, through the pressing contact of the adhesive rubber roller 23 with the photoconductive drum 22, the toner image 4 on the photoconductive drum 22 is transferred to the peripheral surface of the rubber roller 23 because of the sticky or adherent properties of the peripheral surface of the adhesive rubber roller 23.

Then, the solvent mist is supplied from the solvent mist-generating device 5 to the toner image 4 on the adhesive rubber roller 23.

At this time, the lowering of the viscosity of the toner image 4 on the adhesive rubber roller 23 proceeds on such a side that the toner image makes contact with the image bearing sheet 9.

The viscosity of the toner image 4 is sufficiently lowered by the solvent, and in this condition the image bearing sheet 9 is pressed against the adhesive rubber roller 23 by the press roller 6.

Simultaneously when this pressing transfers the toner image 4 to the image bearing sheet 9, the toner image penetrates into the fibers of the image bearing sheet 9 and is fixed thereto. In this condition, the solvent contained in the thus transferred toner evaporates or is dried through the penetration, thereby obtaining the paper in a final recorded form.

At this time, since the toner image 4 has begun to become viscous from that side of the toner image held in contact with the image bearing sheet 9, the amount of the residual (untransferred) toner remaining on the adhesive rubber roller 23 is small. Therefore, there can be obtained a printed image with a higher transfer efficiency than that achieved by a conventional intermediate transfer methods utilizing a dissolving drum.

The residual toner remaining on the adhesive rubber roller 23 is removed by a cleaning unit 7.

If the water content remains on the sticky rubber roller 23 when the cleaning is to be effected by the cleaning unit 7, this water content is also removed by the cleaning unit 7 together with the residual toner.

The residual toner remaining on the photoconductive drum 22 is removed by a cleaner 24, and the electrostatic latent image is eliminated by a static eliminator lamp 25. These steps are basically the same as those in a conventional apparatus.

In addition to the above-mentioned advantages described with reference to the second embodiment of the invention, this third embodiment further has the following advantages.

The solvent is supplied to that portion of the adhesive rubber roller 23 to which the toner image 4 has been once transferred, and therefore the photoconductive drum 22 can be prevented from being exposed to the solvent. This is advantageous when the photoconductive drum 22 does not have a high solvent-resistance.

In this embodiment, although the solvent is supplied to the toner image on the intermediate transfer medium by way of example, there may be used another method in which the solvent is retained on the image bearing medium, and in this condition the image bearing medium is pressed against the toner image on the intermediate transfer medium, thus effecting the transfer.

In the above embodiments, although the photoconductive medium or the dielectric medium (both of which are an electric charge-retaining material) is used as the image carrier, the image carrier may comprise any other suitable electric charge carrier medium, or is not limited to such electric charge carrier mediums.

Although the printing apparatuses of the above embodiments employ the ion projection electrographic printing process or the electrophotographic process, the invention is not limited to such types of apparatuses, and the invention is applicable to any type of printing apparatuses which perform the recording, utilizing toner. For example, a toner image may be formed by a so-called magnetography in which a magnetic latent image is developed by a magnetic toner.

Also, the intermediate transfer medium is not restricted to the sitcky rubber roller, and may include, for example, a dielectric drum, and may be in the form of a belt.

Further, the intermediate transfer medium is not limited to the type which has the sticky surface for transferring a toner image thereto. For example, in the case where an high resistance toner is used, the toner image may be transferred to the intermediate transfer medium by a corona transfer method.

The position of supply of the solvent and the method of supply of the solvent are not limited to those described in the above embodiments.

Further, the state in which the solvent is supplied may be any of a liquid, a mist and vapor.

In the above embodiments, although PPC paper is used as the transfer element, this recording paper may be other materials than PPC paper, such as OHP.

Further, although the residual solvent on the image carrier or on the intermediate transfer medium is removed by the cleaning unit, a heater or the like can be advantageously provided if the cleaning unit is not sufficiently effective in removing the residual solvent.

What is claimed is:

1. A printing apparatus comprising:

(a) image forming means for forming a toner image of a colored toner having viscosity on an image carrier arranged adjacent to a path along which an image bearing medium is conveyed;

(b) solvent supply means for supplying a solvent for lowering the viscosity of said colored toner to said image bearing medium conveyed along said path said solvent supply means arranged along said path upstream of said image carrier;

(c) transfer means for pressing said image bearing medium holding said solvent, against said toner image on said image carrier so that said toner image whose viscosity is lowered by said solvent is transferred onto said image bearing medium.

2. A printing apparatus according to claim 1, wherein said toner image is once transferred from said image carrier onto an intermediate transfer medium arranged adjacent to said image carrier, and said transfer means presses said image bearing medium holding said solvent for lowering the viscosity of said colored toner, against said toner image on said intermediate transfer medium.

3. A printing apparatus according to claim 1, wherein said image carrier comprises an electrical charge carrier member, and said image forming means includes latent image forming means for forming an electrostatic latent image on said image carrier, and developing means for developing said electrostatic latent image with said colored toner.

4. A printing apparatus according to claim 3, wherein said image carrier is made of a dielectric material, and said latent image forming means comprises an ion projecting print head.

5. A printing apparatus according to claim 3, wherein said image carrier comprises and electrophoto-sensitive member, and said latent image forming means comprises electrostatically charging means and exposure means.

6. A printing apparatus according to claim 3, wherein said colored toner is electrically conductive.

7. A printing apparatus comprising:

(a) image forming means for forming a toner image of colored toner having a viscosity on an image carrier;

(b) solvent supply means for supplying, in a non-contact manner, a solvent for lowering the viscosity of said colored toner to said toner image on a side where said toner image makes contact with an image bearing medium; and (c) transfer means for pressing said image bearing medium against said toner image whose viscosity is lowered by said solvent, so as to transfer said toner image onto said image bearing medium.

8. A printing appartus according to claim 7, wherein said solvent supply means supplies, in a non-contact manner, said solvent for lowering the viscosity to said toner image which has been transferred onto an intermediate transfer means.

9. A printing apparatus according to claim 7, wherein said image carrier comprises an electrical charge carrier member, and said image forming means includes latent image forming means for forming an electrostatic latent image on said image carrier, and developing means for developing said electrostatic latent image with said colored toner.

10. A printing apparatus according to claim 9, wherein said image carrier is made of a dielectric material, and said latent image forming means comprises an ion projecting print head.

11. A printing apparatus according to claim 9, wherein said image carrier comprises an electrophotosensitive member, and said latent image forming means comprises electrostatically charging means and exposure means.

12. A printing apparatus according to claim 9, wherein said colored toner is electrically conductive.

* * * * *